US006330939B1

(12) United States Patent
Pratt

(10) Patent No.: US 6,330,939 B1
(45) **Date of Patent: *Dec. 18, 2001**

(54) DEVICE AND METHOD FOR DETERMINING THE AUTHENTICITY OF DOCUMENTS

(76) Inventor: George W. Pratt, 67 Glezen La., Wayland, MA (US) 01778

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/304,813

(22) Filed: May 4, 1999

Related U.S. Application Data

(63) Continuation-in-part of application No. 08/748,819, filed on Nov. 14, 1996, now Pat. No. 5,899,313.

(51) Int. Cl.[7] ..... G07D 7/02

(52) U.S. Cl. ..... 194/206; 324/673

(58) Field of Search ..... 194/205, 206, 194/207, 212, 213, 303, 317; 324/663, 672, 673, 674, 675; 209/534

(56) References Cited

U.S. PATENT DOCUMENTS

| | | | | |
|---|---|---|---|---|
| 4,300,041 | * | 11/1981 | Nama | 194/210 X |
| 4,458,143 | | 7/1984 | Gitlis | 235/449 |
| 4,536,709 | | 8/1985 | Ishida | 324/239 |
| 4,628,194 | | 12/1986 | Dobbins et al. | 235/379 |
| 4,834,230 | | 5/1989 | Kondo et al. | 194/206 |
| 5,122,754 | | 6/1992 | Gotaas | 324/676 |
| 5,261,518 | | 11/1993 | Bryce | 194/206 |
| 5,308,992 | | 5/1994 | Crane et al. | 250/556 |
| 5,394,969 | | 3/1995 | Harbaugh | 194/206 |
| 5,417,316 | | 5/1995 | Harbaugh | 194/206 |
| 5,419,424 | | 5/1995 | Harbaugh | 194/206 |
| 5,869,973 | * | 2/1999 | Nosov | 324/678 |

* cited by examiner

*Primary Examiner*—F. J. Bartuska
(74) *Attorney, Agent, or Firm*—Samuels Gauthier & Stevens, LLP

(57) ABSTRACT

There is a large difference in frequency dependent, complex electrical permittivity between genuine and counterfeit documents, including paper currency. Genuine bills have a substantially different complex permittivity which is distinct from the permittivity of counterfeit bills. The invention broadly measures the complex permittivity, $\epsilon$, of the 'paper' bills to determine if the bill(s) is genuine or counterfeit. In one aspect, the present invention comprises a device and method for determining the genuineness of a document by measuring the complex permittivity based on the frequency dependent dielectric properties of the document. The complex electric permittivity of a dielectric material is typically read by measuring complex impedance using a capacitor to sense material properties. The document may include an enhanced region comprising an additive that establishes a known permittivity in the enhanced region. For example, the enhanced region may be established by using a "smart ink" that is applied to the document, or a dopant that may be built into the document itself. The "smart ink" or dopant may include carbon nanotubes, barium titanate, barium strontrium, or in general ferroelectric materials having a relatively high permittivity and a ferroelectric transition point that is above room temperature (e.g., lithium niobate, rochelle salt, sodium niobate, lithium tantalate). To determine the authenticity of the document, the permittivity of the enhanced region is measured. Advantageously, providing the enhanced region changes the local properties of the document to prevent document counterfeiting.

30 Claims, 7 Drawing Sheets

DEVICE AND METHOD FOR DETERMINING THE AUTHENTICITY OF DOCUMENTS

CROSS-REFERENCE TO RELATED APPLICATIONS

This application is a continuation-in-part application of U.S. Patent application designated Ser. No. 08/748,819, filed Nov. 14, 1996 now U.S. Pat. No. 5,899,313.

BACKGROUND OF THE INVENTION

The invention relates to a method and apparatus for discriminating between genuine and counterfeit documents, and in particular to sensing the complex electric permittivity characteristics of a document (e.g., paper currency, tickets, documents, etc) to determine its authenticity.

Genuine U.S. paper currency contains a variety of printed indicia which may be used to identify the currency as authentic, and also to distinguish between authentic currency of various denominations.

One indication of authenticity is the fact that certain areas on a U.S. bill are printed with ink with magnetic properties. For example, the portrait which appears in the center of every U.S. bill is, in a genuine bill, printed entirely with magnetic ink. The fanciful engraving which forms the printed border of each U.S. bill is likewise composed entirely of magnetic ink, as are the large capital letters or large numerals which appear to the right of the portrait and which identify the denomination of the bill (i.e., "ONE", "TWO", "FIVE", etc.). In contrast, the green Treasury Department seal that underlies the denomination identifying letters or numerals to the right of the portrait, as well as the black Federal Reserve Bank seal which appears to the left of the portrait, are both printed in non-magnetic ink Each denomination U.S. bill is likewise characterized by the distance between the grid lines which comprise the background of the portrait field. In one dollar bills, for example, the space between vertical grid lines is equal to 0.008 inches. For two and five dollar bills, the grid line space is equal to 0.010 and 0.011 inches, respectively.

Prior art currency validators have been proposed that identify authentic U.S. bills and distinguish between bills of various denominations by measuring the average spacing between the vertical grid lines in the portrait areas of the bills. One such device is disclosed in U.S. Pat. No. 4,349,111 to Shah et al.

Identification of bills based on average grid line spacing is likely to lead to failures to distinguish between bills having relatively small differences in grid spacing. For example, certain commercial bill validators utilizing the average spacing technique cannot be used with both two dollar and five dollar bills, because the average grid line spacings are too similar.

Another problem with various prior art validators is that they may accept high denomination bills as valid lower denomination bills.

Many prior art current validators require that the tested bill be inserted into the validator in a specific orientation (e.g., Federal Reserve seal first). Such devices result in authentic bills being rejected merely because of improper orientation.

Many of the prior art currency validators require careful regulation of the speed at which the bill is scanned for information. In such validators, even a slight variation in scanning speed, such as that resulting from an instantaneous drop in power line voltage, can cause authentic bills to be rejected and produce inaccuracies in the identification of bill denomination. It is therefore desirable to provide a currency validator which is insensitive to the speed at which a bill is scanned.

In order to avoid some of the problems of speed regulation, some prior art validators, such as disclosed in U.S. Pat. No. 4,464,787 to Fish et al., employ detectors at fixed positions by positively identifying the position of the bill and thereby ascertain the bill area being tested. These validators, however, generally require a testing channel at least as long as the bill being tested.

In recent years, the high quality of copying and printing machines has resulted in a serious counterfeiting problem. One of the countermeasures against counterfeiting which has been adopted in many countries is the use of a metal embedded in paper checks or currency notes. However, metal detectors for automatically discriminating between genuine and counterfeit currency notes and checks by detecting the metal strip have not been put to practical use because they have not been capable of accurate and reliable detection of the metal strips at high speed.

An image (on a bill) can be scanned with a resolution of 300 or 600 dots per inch and the stored imager printed using inkjet printers that can match virtually any color.

The problem of counterfeiting is not limited to paper currency. Other documents such as checks, stock certificates, and airline and event tickets may also be subject to counterfeiting.

Therefore, there is a need to reliably verify the authenticity of various types of documents.

SUMMARY OF THE INVENTION

There is a large difference in frequency dependent, complex electrical permittivity between genuine and counterfeit documents, including paper currency. Genuine bills have a substantially different complex permittivity which is distinct from the permittivity of counterfeit bills. The invention broadly measures the complex permittivity, $\epsilon$, of the 'paper' bills to determine if the bill(s) is genuine or counterfeit. In one aspect, the present invention comprises a device and method for determining the genuineness of a document by measuring the complex permittivity based on the frequency dependent dielectric properties of the document.

The complex electric permittivity of a dielectric material is typically read by measuring complex impedance using a capacitor to sense material properties. There are a wide variety of techniques known in the art for measuring capacitance including RF bridge circuits, oscillators, etc. Preferably, the permittivity is sensed as it affects the complex impedance. This may be expressed as it affects the resonant frequency of an oscillator such as a Wein bridge or phase shift oscillator. Electrodes are placed in electrical communication with the document to be tested. The electrodes may be on opposite sides of the document, or arranged as interdigitated electrodes on the same side. For example, if interdigitated electrodes are used, the spacing between the electrodes is set so the fringing electric field permeates the bill, typically 0.004" thick, but does not significantly penetrate the material beneath the bill, i.e., the support surface.

When the sensing electrodes engage the document, a capacitor is formed. This is due either to the field penetrating the document between electrodes on opposite sides or due to the fringing field. The value of the capacitance is strongly affected by the electric permittivity of the document. The capacitor forms part of an oscillator such as a Wien bridge oscillator or a phase shift oscillator, although any oscillator circuit will function as long as its resonance frequency depends upon the value of a capacitor and that capacitor can be formed by the electrode-currency combination. Moisture often affects the surface conductivity of the document. This can be accounted for by modeling the document as a capacitor in parallel with a surface resistance. Moisture effects will be less pronounced when using electrodes on each side of the document.

It is also within the scope of the invention that the complex electric permittivity of the document may be sensed at a plurality of frequencies. At each of these frequencies, the real and imaginary impedance may be measured, or more generally quantities $Q_1$ and $Q_2$ from which the real and imaginary impedance can be derived. For example, the sensing circuit used to interrogate the document may be driven by an input sinusoid $V_{IN}$ of known frequency and amplitude. The phase shift of the output signal $V_{OUT}$ with respect to $V_{IN}$ may be $Q_1$, while the amplitude of $V_{OUT}$ may be the second quantity $Q_2$. From these two values the real and imaginary impedance values can be calculated. These measurements (readings) are compared against a standard, corresponding to a genuine document, which may include using discriminant analysis techniques. An output indicates whether the document is counterfeit or genuine.

Several models can be used to sense the electric permittivity of the currency (e.g., a total impedance model, a voltage divider model or a bridge model). The bridge model may comprise two similar arms of impedance $Z_A$ and $Z_B$, each of which is a parallel combination of a resistor and a capacitor. The parallel combinations of these arms are separately in series with impedance $Z_C$ and $Z_D$ forming arms C and D. The bridge voltage is read between the nodes at the junction of arm A and arm C and the junctions of arms B and D. Impedance elements $Z_C$ and $Z_D$ may be purely resistive.

The document may include an enhanced region comprising an additive that establishes a known permittivity in the enhanced region. For example, the enhanced region may be established by using a "smart ink" that is applied to the document, or a dopant that may be built into the document itself. The "smart ink" or dopant may include carbon nanotubes, barium titanate, barium strontrium, or in general ferroelectric materials having a relatively high permittivity and a ferroelectric transition point that is above room temperature (e.g., lithium niobate, rochelle salt, sodium niobate, lithium tantalate). To determine the authenticity of the document, the permittivity of the enhanced region is measured. Advantageously, providing the enhanced region changes the local properties of the document to prevent document counterfeiting.

The enhanced region may also include micro transponders. The transponders may be fabricated, passive, micro circuit elements, such as dipoles, filter elements or antennas including micro resistors and micro capacitors that provide a characteristic electromagnetic response that is identifiable by a sensing circuit.

These and other objects, features and advantages of the present invention will become apparent in light of the following detailed description of preferred embodiments thereof, as illustrated in the accompanying drawings.

DETAILED DESCRIPTION OF THE INVENTION

There is a significant difference in the frequency dependent real part of the electrical permittivity between genuine and counterfeit bills regardless of the denomination. The genuine currency always has a substantially higher e at frequencies up to 1 MHz.

Figure 1:
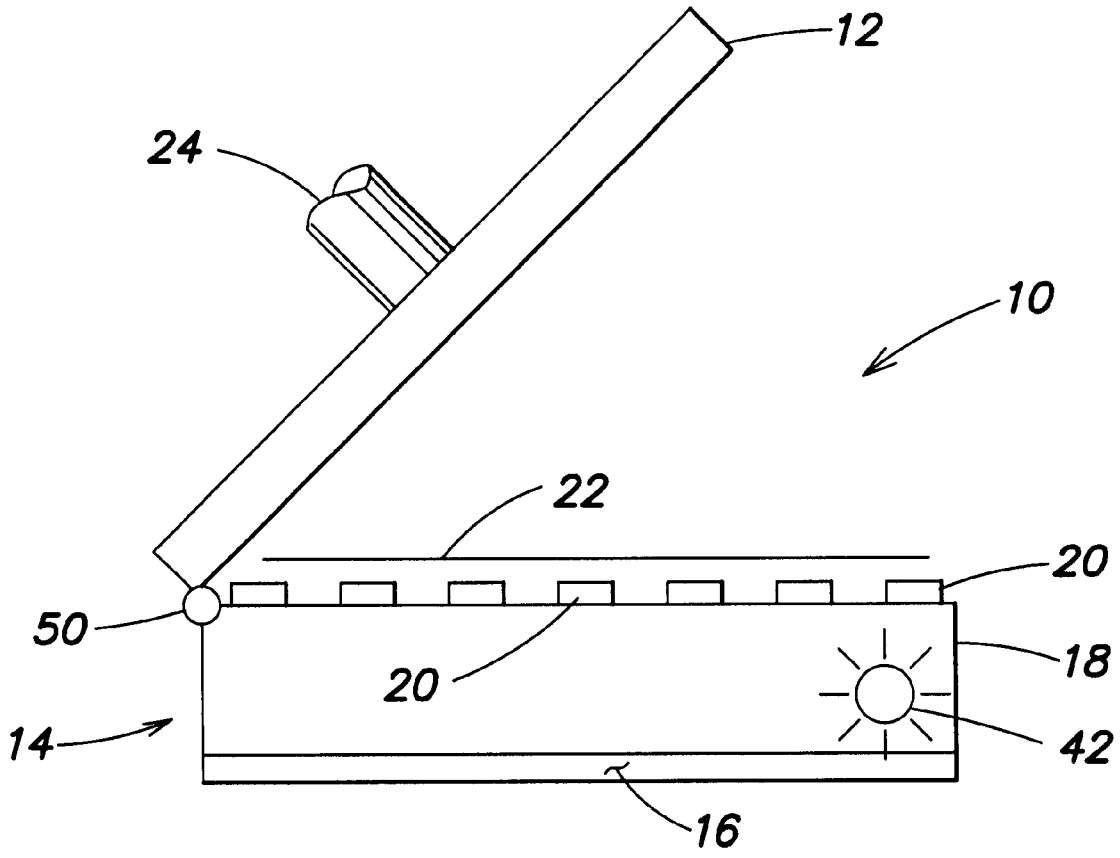
FIG. 1 is an illustration of a document authenticator.

FIG. 1 illustrates a document authenticator 10 comprising a Teflon cover 12 hinged at 50 to a base shown generally at 14. The base 14 comprises a ground plane 16, a substrate 18 (e.g., Kapton) and interdigitated electrodes 20 (shown more clearly in FIGS. 2 and 3). The electrodes 20 are coated with a coating having a materiel free of pin holes, conformability on irregular surfaces, excellent solvent resistance, high dielectric strength in thin layers and low dielectric permittivity. A suitable material is parylene. For a more detailed discussion of interdigitated electrode design and theory see Mamishev, et al., Techniques for Semi-Imperical Characterization of Material and Sensor Properties in Interdigital Dielectromity. A document 22 (e.g., currency, a check, a ticket, a stock certificate, a manufacturer's certificate of authenticity, etc.) is sandwiched between the electrodes 20 and the cover plate 12. A pressure controlling device 24 applies a standardized pressure to the document 22. A lamp 42 signals whether or not the document is genuine.

Figure 2:
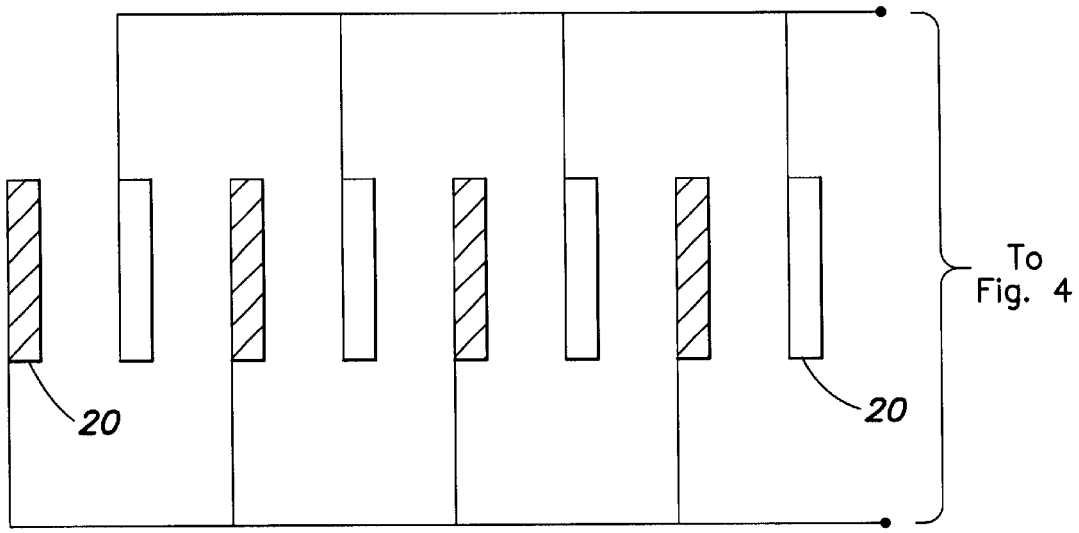
FIG. 2 is a top schematic view of an interdigitated electrode array.
Figure 3:
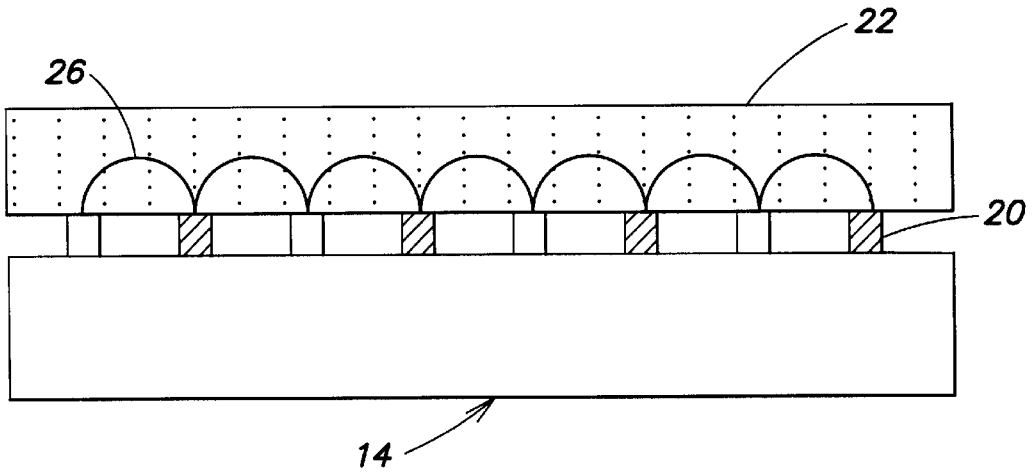
FIG. 3 is a schematic of the electrodes of FIG. 2.

Referring to FIGS. 2 and 3 the electrodes 20 are shown in greater detail with FIG. 3 illustrating the fringing electric field line as 26. The document 22 is shown in exaggerated form.

In a preferred embodiment, an interdigitated electrode with a period of one millimeter is preferred. The electrodes (metal fingers) are about 0.5 mm wide and 0.1 mm thick and the gap between the electrodes is about 0.5 mm. The electrodes are received on a Kapton® flexible substrate. With a sensing frequency in the vicinity of 10 kHz the permittivity can be determined in a time frame of milliseconds. The device measures the current between the fingers of the interdigitated electrodes which is CdV/dt where C is the sensed capacitance and dV/dt is the time rate of change of the interdigitated applied voltage.

Figure 4:
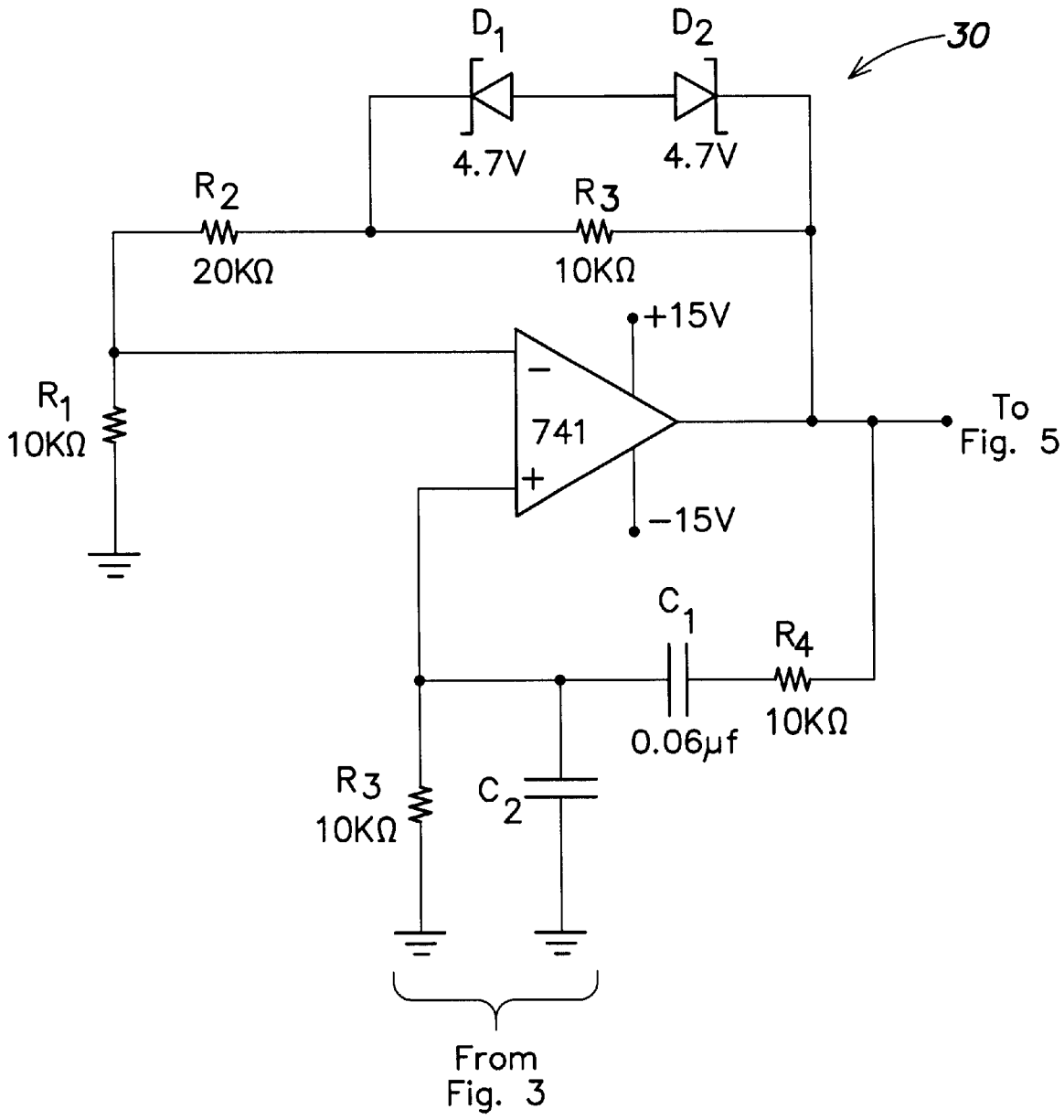
FIG. 4 is a schematic of an oscillator.

Referring to FIG. 4, an oscillator such as a Wein bridge oscillator is shown at 30. An operational amplifier 741 is configured with two 0–15 volt power supplies.

$C_2$ is the capacitance sensed by the electrode.

$$\text{frequency}\,\omega = \sqrt{\frac{1}{R_3 R_4 C_1 C_2}}$$

-continued $$f = 10\,\text{KHz} = \frac{\omega}{2\pi}$$

$$\omega = 6.28 \times 10^4\ \text{rads/sec}$$

$\omega = 6.28 \times 10^4$ rads/sec when $C_2$=1.67 nanofarads

Figure 5:
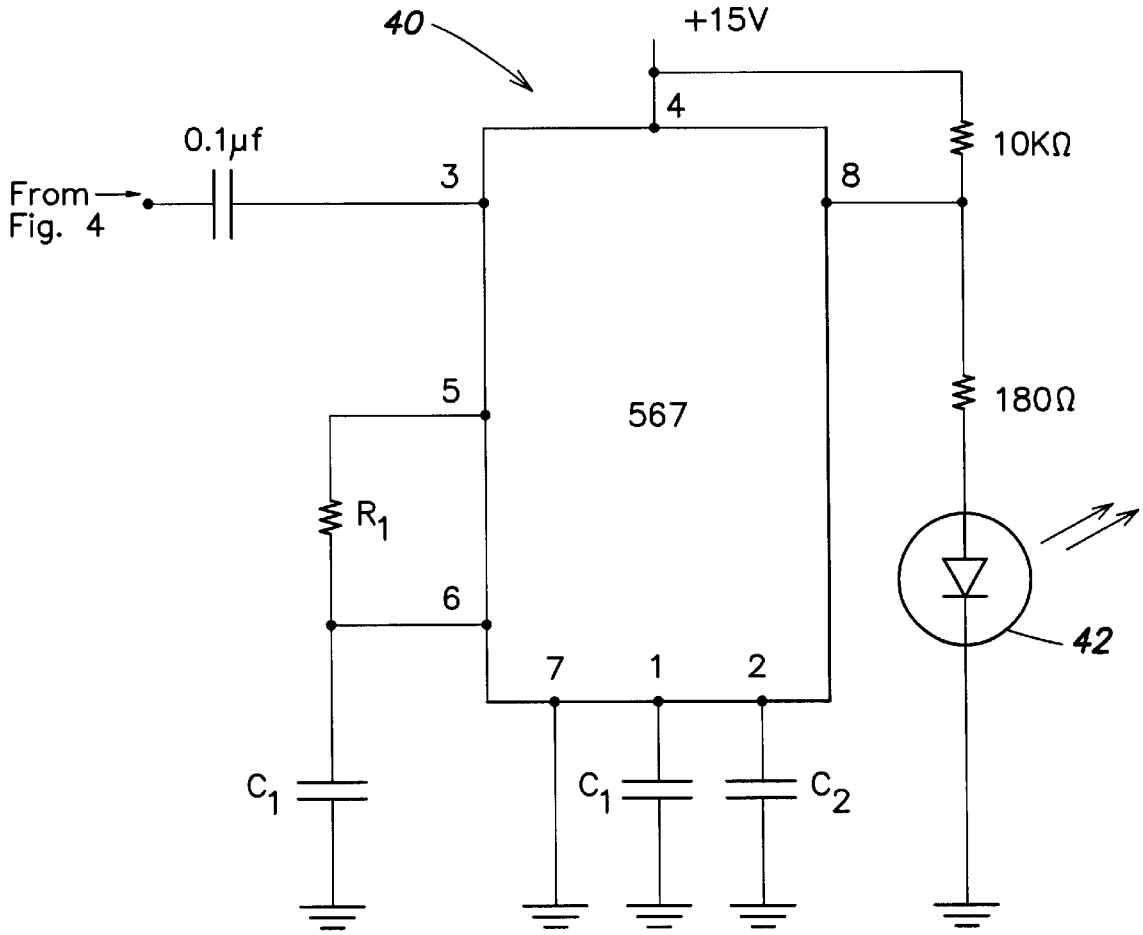
FIG. 5 is a schematic of tone detector.

Referring to FIG. 5, a tone detector 40 is shown which is a phase lock loop that contains a voltage controlled oscillator. The frequency output of the oscillator is:

$$f = \frac{1}{\sqrt{R_3 R_4 C_1 C_{sample}}}$$

Since counterfeit bills have always been found to have a lower real part of the electrical permittivity, i.e. $\epsilon_1$, the $C_{money}$ for counterfeit bills will be lower than $C_{money}$ for genuine U.S. bills. Therefore, the oscillator 30 will oscillate at a higher frequency for counterfeit bills than for genuine bills.

The circuit components are chosen in this example so the genuine bills will cause the oscillator to oscillate between two frequencies, e.g. 10,750 Hz and 9,250 Hz. In general, counterfeit bills will provide a Wein bridge oscillation greater than 10,750 Hz. The phase locked loop 40 goes from unlocked to locked at different frequencies depending upon whether the frequency fed to the phase locked loop is increasing or decreasing.

Figure 6B:
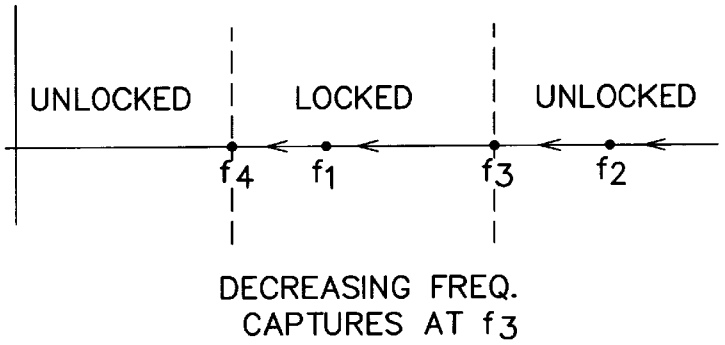
FIGS. 6*a* and 6*b* are frequency diagrams.
Figure 6A:
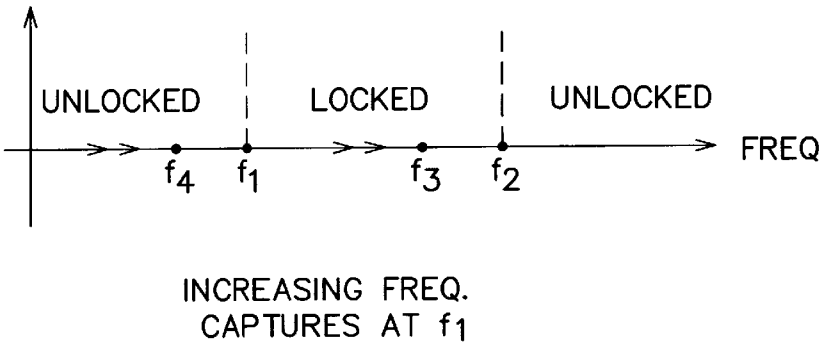

With reference to FIGS. 6*a* and 6*b,* when there is no bill under the sensor the frequency of the Wein bridge will increase with decreasing $C_{sample}$. When the sensor is pressed against the paper bills as the contact becomes more intimate due to applied pressure $C_{money}$ will increase and frequency oscillation will decrease. If the sensor is pressed against the counterfeit bill the frequency oscillation will not decrease enough to reach $f_3$ and the lamp 42 will remain illuminated. If the sensor is pressed against genuine bills the frequency oscillation will read or go below $f_3$. Capture then will be achieved and the lamp 42 will be actuated. The free running frequency, $f_0$, of the decoder is approximately $$f_o \cong \frac{1}{R_1 C_1}\text{Hz}$$

$$\text{Let } f_o = 10\,\text{kHz}$$

Assuming a 15% drop in permittivity from genuine to counterfeit bills, $f_3$ should be above $f_0$ by an amount that reflects this change in permittivity. Then using the relationship between $\Delta f$ and $\Delta C_{money}$ we can write:

$$\left|\frac{\Delta f}{f}\right| = \left|1/2\frac{\Delta C_{sample}}{C_{sample}}\right|$$

where $$\frac{\Delta C_{sample}}{C_{sample}} = 0.15$$

If f is chosen as 10 kHz, then $\Delta f$=750 Hz. Therefore, let $f_3$ the captive frequency, be 10,750 Hz.

As the sensor is pressed against the bill to be tested, the bridge oscillator frequency will decrease and the LED is on. That frequency must decrease below 10,750 Hz to turnoff the LED indicating that the bill is genuine.

The spacing between fingers is set so that the fringing electric field penetrates the bill, typically 0.004 inches thick, but does not significantly penetrate the material beneath the bill. That material may be selected to have optimum dielectric properties, although such a selection may not be necessary.

In tests conducted on U.S. bills of various denominations, the results at 10 kHz alone distinguished between genuine bills and counterfeit bills supplied by the Secret Service. The present invention is applicable to document other than paper currency.

Figure 7:
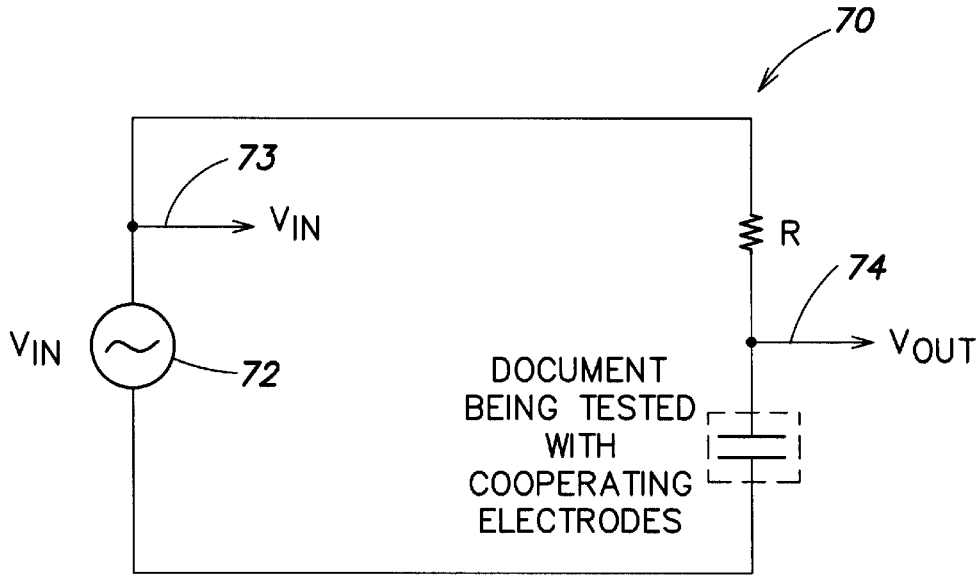
FIG. 7 is a simplified illustration of a document authenticator.
Figure 8:
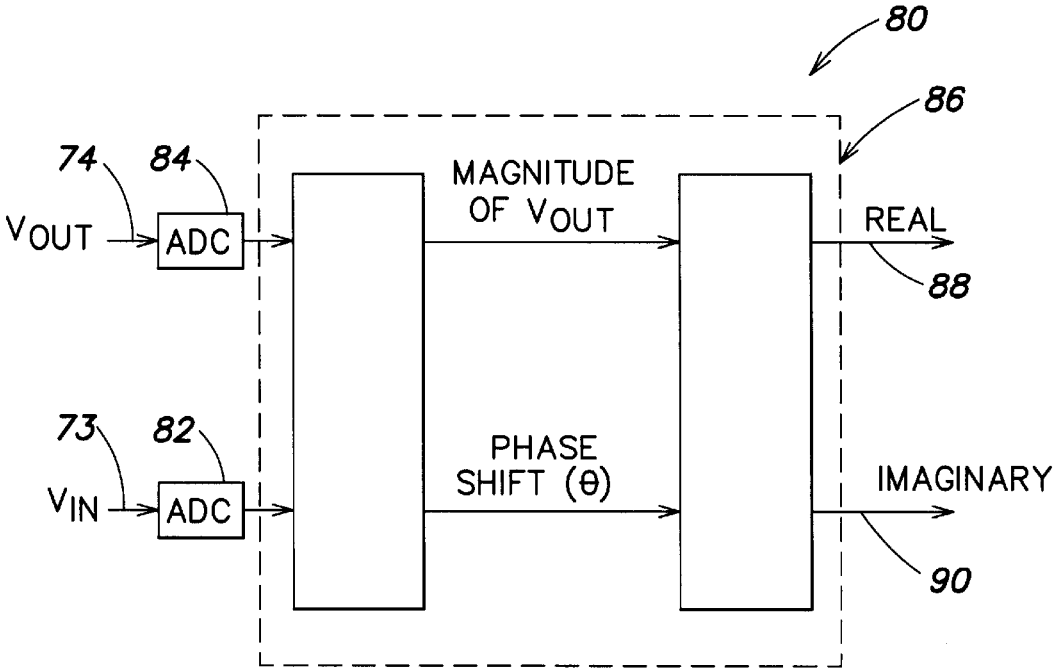
FIG. 8 illustrates a functional block diagram of a detector that cooperates with the authenticator of FIG. 7.

FIG. 7 is a simplified illustration of a document authenticator 70 that includes an input signal generator 72 that provides a periodic input signal $V_{IN}$ on a line 73, which is applied across the document to be authenticated using electrodes. The authenticator 70 provides an output signal $V_{OUT}$ on a line 74 that is processed to determined the authenticity of the document. FIG. 8 illustrates a functional block diagram illustration of a detector 80 for processing the signal $V_{OUT}$. The detector 80 includes analog-to-digital converters (ADC) 82, 84 that digitize $V_{IN}$ and $V_{OUT}$, respectively. The digitized signals are input to a processing circuit 86 (e.g., a digital signal processor), which processes the two signals to provide the real and imaginary components of the document permittivity on lines 88, 90 in order to assess the authenticity of the document. One of ordinary skill in the art will appreciate that the processing circuit 86 may also make a judgment on the authenticity of the document based upon the real and imaginary permittivity values on the lines 88, 90. The function of the processing circuit 86 circuit may be performed by devices other than a DSP. For example, a conventional CPU, an ASIC, or discrete components may be used.

Figure 9:
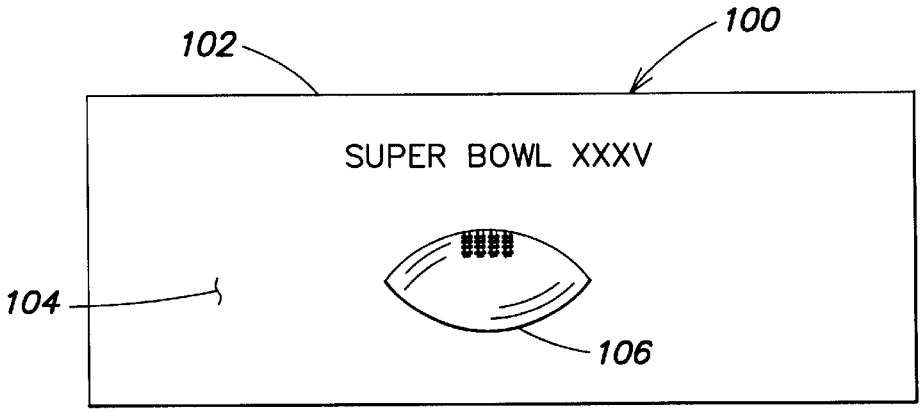
FIG. 9 is a pictorial illustration of a document event ticket having an enhanced region comprising an additive that establishes a known permittivity in the enhanced region.

FIG. 9 is a pictorial illustration of a document event ticket 100 having an enhanced region 102 that comprises an additive, which establishes a known permittivity in the enhanced region 102. As shown, the enhanced region 102 may be established by depositing a "smart ink" onto the surface 104 of the ticket 100 in the form of lettering. One or more of the letters may include the "smart ink". In addition, the ticket may include an image 106 (e.g., a football, a picture of a stadium, a corporate logo, etc.) that is printed onto the ticket with the "smart ink". The ink may include carbon nanotubes, barium titanate, barium strontrium, or in general ferroelectric materials having a relatively high permittivity and a transition impedance that is above room temperature (e.g., lithium niobate, rochelle salt, sodium niobate, lithium tantalate). The smart ink may be formulated to be colorless to conceal its location on the document to be tested. To determine the authenticity of the document, the permittivity of the enhanced region is measured.

The enhanced region may also be established by doping the paper pulp during the paper document manufacturing process. The dopants added to the pulp during the manufacturing process are primarily those identified in the preceding paragraph. In this embodiment, the enhanced region may be the entire document, such as for example a bank check or a manufacturer's tag of authenticity (e.g., for a Rolex™ watch).

The smart ink that established the enhanced region may also include micro transponders. The transponders may be fabricated, passive, micro circuit elements, such as dipoles, filter elements or antennas including micro resistors and micro capacitors that provide a characteristic electromagnetic response that is identifiable by a sensing circuit. The micro transponders may be physically blended into the ink without compromising the properties of the ink necessary for printing. The transponders may be used with either dry ink or fluid inks. In addition, the micro transponders can be designed to either emit or absorb electromagnetic energy when excited by a sensing circuit.

The enhanced region may include piezoelectric thin films such as polyvinylidene flouride (PVDF) that are be printed in a form such as a bar code or simply as any symbol. When illuminated by an optical source (e.g., LED, laser, etc.) these films absorb optical energy that changes the index of refraction. The optical changes can be detected by several techniques, including the change in reflectivity. Changes in the index and in physical shape also take place when the PVDF film is irradiated both by light (opto-mechanical) and by a sound wave. Consider, for example, a bar code made using a PVDF film, which is illuminated by an LED pulsed at 100 Hz, or excited with a pulsed sound wave with a pulse repetition rate of 500 KHz. The optical properties of the bar code would be modulated at 100 Hz for light, or 500 KHz for sound. The bar code can be read using a synchronous detector tuned to the reflected signal at 100 Hz for optical, or 500 KHz for ultrasonic. If the bar code is not made of a material that responds to a flashing LED or pulsing sound source, the synchronous detector will not receive the proper response.

A specific array of interdigitated electrodes has been described. It is well within the skill of the art to use other arrays of electrodes either on one side or both sides of the document. Further, other forms of oscillators are well within the scope of the invention as well as other detection schemes to determine whether a bill is genuine or counterfeit.

A preferred embodiment has been described with reference to measuring the permittivity at a frequency of 10 kHz. Other frequencies obviously can be used to achieve the same result. Further, if desired the permittivity of the documents can be tested at more than one frequency. For example, the bills may be tested at 10 kHz, 100 kHz and 1 MHz to further validate the scheme.

Figure 10A:
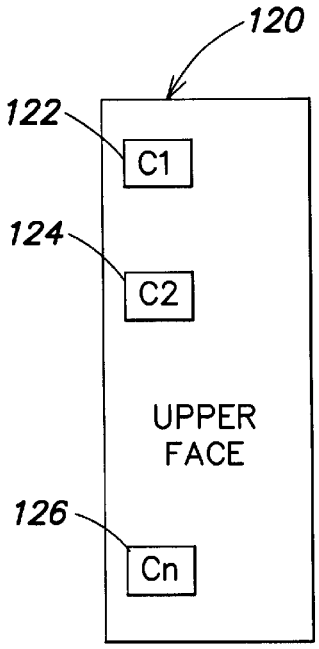
FIGS. 10A and 10B are pictorial illustrations of upper faces and lower faces of a credit card or ATM card according to another aspect of the present invention.
Figure 10B:
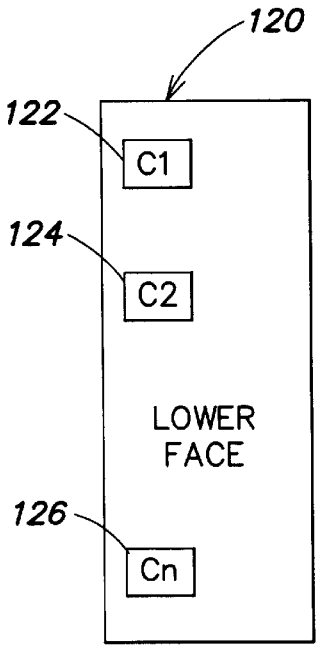

It is further contemplated that materials of different complex dielectric permittivity can be used to encode information in a credit card or key or other device used to establish an identity or authenticate a transaction. For example, a pattern of different dielectric materials can be fabricated into the structure of a credit card so that as the card is interrogated by a reading device, the permittivity of each element of the pattern is sensed so as to perform a step in the process of identification or authentication. Consider for example a credit card 120 illustrated in FIGS. 10A and 10B. FIGS. 10A and 10B are pictorial illustrations of upper faces and lower faces, respectively, of the credit card 120 or ATM card. The credit card 120 includes a series of electrode pairs C1 122, C2 124 and Cn 126 arranged in a linear pattern of different dielectric materials, wherein each electrode pair is interrogated (e.g., in a serial manner) by a sensor device whose response depends on the permittivity sensed across the electrode pair. The dielectric material is located between the upper face and lower face electrodes that define an electrode pair. Alternatively, the elements may be sensed in parallel. A sensor device such as an RF bridge, a circuit sensitive to an RC time constant, or an oscillator whose frequency depends on a capacitance are examples of such sensor devices. The result of the interrogation of each element in the pattern may be in binary form, zero or one. Alternatively, in view of the wide range of dielectric permittivities of materials, the dielectric element may be read in an analogue manner to produce numbers between zero and nine or alphabetical letters. Apatite has a dielectric constant at 300 MHz of 9.5 perpendicular to the optic axis and 7.41 parallel to the optic axis. Other birefringent materials such as rutile, quartz and ruby have similar orientation dependent dielectric behavior. Thus information may be encoded in the pattern by altering the orientation of the dielectric in each element of the pattern. As well as using a combination of birefringent materials and orientations to encode information. Clearly, optical means can be used to interrogate the dielectric element where light transmitted through or reflected from the dielectric element in the pattern is detected by an optical sensor.

Referring still to FIGS. 10A and 10B, the dielectric pattern sensed across the electrode pairs 122, 124 and 126 may be fabricated into a card device acting as a key to unlock a door, start a car, operate a machine or use a firearm, etc. The lock device would contain the sensing elements and would read the encoded information of the key device when inserted into the lock. An advantage of dielectric encoding is the level of sophistication needed to write the desired information into the dielectric pattern. This is to be compared with the relative ease of recording information on magnetic tape as used in credit cards or in magnetic ink as used in several types of financial instruments.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

What is claimed is:

1. A method of determining the authenticity of a document having a known permittivity, said method comprising the steps of:

sensing complex electric permittivity of the document based on frequency dependent dielectric properties of the document using a plurality of interdigitated electrodes arranged substantially in a plane and electrically excited by a sensing circuit, wherein the document is positioned against the interdigitated electrodes;

providing an output corresponding to the sensed permittivity; and processing the output to provide an indication regarding whether or not the document is genuine.

2. The method of claim 1 wherein sensing the electric permittivity of the document comprises measuring impedance.

3. The method of claim 2 wherein said step of sensing comprises contacting the document with electrodes to form a capacitor.

4. The method of claim 1 wherein processing of the output comprises:

outputting a frequency corresponding to a measured capacitance; and sensing if the frequency is within a predetermined range which corresponds to a genuine document.

5. The method of claim 1, wherein said step of sensing complex permittivity of the document includes sensing the complex permittivity of an enhanced region of the document, wherein the enhanced region includes an additive that establishes the known permittivity in the enhanced region.

6. The method of claim 5, wherein the additive is included in ink which is deposited onto the document to establish the enhanced region.

7. The method of claim 5, wherein the additive is integral with fibers of the document to establish the enhanced region.

8. The method of claim 5, wherein said additive comprises a high dielectric material selected from the group of carbon nanotubes, barium titanate, barium strontrium, and ferroelectric materials having a relatively high permittivity and a transition impedance that is above room temperature such as lithium niobate, rochelle salt, sodium niobate, lithium tantalate.

9. The method of claim 5, wherein the additive includes micro transponders.

10. The method of claim 5, wherein the enhanced region is a bar code.

11. A device for determining the genuineness of a document having a known permittivity, said device comprising:

means for measuring permittivity of the document based on frequency dependent dielectric properties of the document, comprising a plurality of interdigitated electrodes arranged substantially in a plane and electrically excited by a sensing circuit, wherein the document is positioned against said interdigitated electrodes and said electrodes measure the permittivity across a substantial portion of the document;

means for providing an output corresponding to the measured permittivity; and means for processing the output to provide an indication regarding whether or not the document is genuine.

12. The device of claim 11 wherein said means for measuring the permittivity of the document comprises means for measuring capacitance.

13. The device of claim 12 wherein said means for measuring capacitance comprises an RF bridge circuit.

14. The device of claim 11 wherein said means for measuring comprises:

a plurality of electrode sensors adapted to engage the document and to form with the document a capacitor.

15. The device of claim 14 wherein said means for measuring comprises:

an oscillator circuit whose resonant frequency depends upon the value of the capacitor formed by the electrode-document combination.

16. The device of claim 11 wherein said means for processing the output comprises a tone decoder.

17. The device of claim 16 wherein the tone decoder is a phase locked loop circuit.

18. A device for determining the genuineness of a document having a known permittivity, said device comprising:

means for measuring permittivity of the document based on frequency dependent dielectric properties of the document, comprising a plurality of coated electrodes arranged on opposite sides of the document and electrically excited by a sensing circuit; and means for providing an output corresponding to the measured permittivity and for processing the output to provide an indication regarding whether or not the document is genuine.

19. The device of claim 18, wherein said means for measuring comprises the step of measuring the permittivity across an enhanced region having the known permittivity, wherein said enhanced region defines a portion of the surface area of the document.

20. The device of claim 18, wherein said means for measuring permittivity includes means for sensing the complex permittivity of an enhanced region of the document, wherein the enhanced region includes an additive that establishes the known permittivity in the enhanced region.

21. The device of claim 20, wherein the additive is included in ink which is deposited onto the document to establish the enhanced region.

22. The device of claim 20, wherein the additive is integral with fibers of the document to establish the enhanced region.

23. The device of claim 20, wherein said additive comprises a high dielectric material selected from the group comprising carbon nanotubes, barium titanate, barium strontrium titanate, and ferroelectric materials having a relatively high permittivity and a ferroelectric transition point above room temperature such as lithium niobate, rochelle salt, sodium niobate, lithium tantalate.

24. The device of claim 20, wherein the additive includes micro transponders.

25. The device of claim 18, wherein said coated electrodes comprise electrodes coated with parylene.

26. A method of authenticating an object, comprising the steps of:

determining the complex permittivity of the object; and comparing the measured complex permittivity of the object against a known standard to determine the authenticity of the object, wherein said step of determining the complex permittivity of the object includes sensing the complex permittivity of an enhanced region of the object, wherein the enhanced region includes an additive selected from the group comprising carbon nanotubes, barium titanate, barium strontrium, microtransponders and ferroelectric materials having a relatively high permittivity and a ferroelectric transition point that is above room temperature such as lithium niobate, rochelle salt, sodium niobate, lithium tantalate, such that the additive establishes a known permittivity in the enhanced region.

27. The method of claim 26, wherein the complex permittivity of the object is patterned in a form so that information can be written into said pattern and read therefrom.

28. The method of claim 26, wherein the object is a key.

29. The method of claim 26, wherein the object is a credit card.

30. The method of claim 26, wherein the object is a gaming chip.

* * * * *